US006295850B1

(12) United States Patent
Anderson

(10) Patent No.: US 6,295,850 B1
(45) Date of Patent: Oct. 2, 2001

(54) KEY-OPERATED CYLINDER LOCK WITH REMOVABLE PLATE TUMBLER CONTAINER

(75) Inventor: Victor R. Anderson, Trumbull, CT (US)

(73) Assignee: Loctec Corporation, Newtown, CT (US)

( * ) Notice: Subject to any disclaimer, the term of this patent is extended or adjusted under 35 U.S.C. 154(b) by 0 days.

(21) Appl. No.: 09/289,030

(22) Filed: Apr. 9, 1999

(51) Int. Cl.[7] ..... E05B 35/08; E05B 9/04; E05B 29/00

(52) U.S. Cl. ..... 70/492; 70/337; 70/367; 70/369; 70/374

(58) Field of Search ..... 70/492, 370, 371, 70/373, 374, 381, 448, 449, 451, 375, 337, 340

(56) References Cited

U.S. PATENT DOCUMENTS

| | | | | |
|---|---|---|---|---|
| 1,644,092 | * | 10/1927 | Shinn . | |
| 1,969,012 | * | 8/1934 | Jacobi . | |
| 2,061,456 | * | 11/1936 | Falk | 70/369 |
| 2,194,244 | * | 3/1940 | Machinist . | |
| 3,261,189 | * | 7/1966 | Best | 70/337 |
| 3,604,230 | * | 9/1971 | Tixler | 70/373 |
| 4,052,870 | * | 10/1977 | Degeye et al. | 70/375 |
| 4,211,097 | * | 7/1980 | Martikainen et al. | 70/373 |
| 4,381,656 | * | 5/1983 | Hayakawa | 70/370 |
| 4,598,563 | * | 7/1986 | Berkowitz | 70/375 |
| 4,756,638 | * | 7/1988 | Neyret | 70/451 |
| 4,926,670 | * | 5/1990 | Deforrest, Sr. | 70/374 |
| 5,109,685 | * | 5/1992 | Westwinkel | 70/369 |
| 5,182,929 | * | 2/1993 | Myers | 70/340 |
| 5,251,467 | * | 10/1993 | Anderson | 70/370 |
| 5,431,034 | * | 7/1995 | Fann et al. | 70/337 |
| 5,964,110 | * | 10/1999 | Crocco et al. | 70/337 |

FOREIGN PATENT DOCUMENTS

| | | | | |
|---|---|---|---|---|
| 295204 | * | 10/1991 | (DE) | 70/374 |

* cited by examiner

*Primary Examiner*—Darnell Jayne
(74) *Attorney, Agent, or Firm*—Melvin I. Stoltz

(57) ABSTRACT

By operationally mounting a plurality of wafers or plates forming tumblers in an independent, separate, substantially closed container, and cooperatively mounting the plate tumbler container with a cylinder forming member, a unique cylinder lock system is attained which is easily and inexpensively manufactured, as well as quickly and easily re-keyed whenever desired. In the preferred embodiment, all of the plate tumblers which are desired for the particular lock construction are mounted in the substantially closed container, with each plate tumbler having the requisite spring means associated therewith. In addition, the plate tumbler holding container incorporates one aperture for each plate tumbler which allows the slot engaging fin of each tumbler to extend outwardly from the container for locking and unlocking association with the housing.

18 Claims, 9 Drawing Sheets

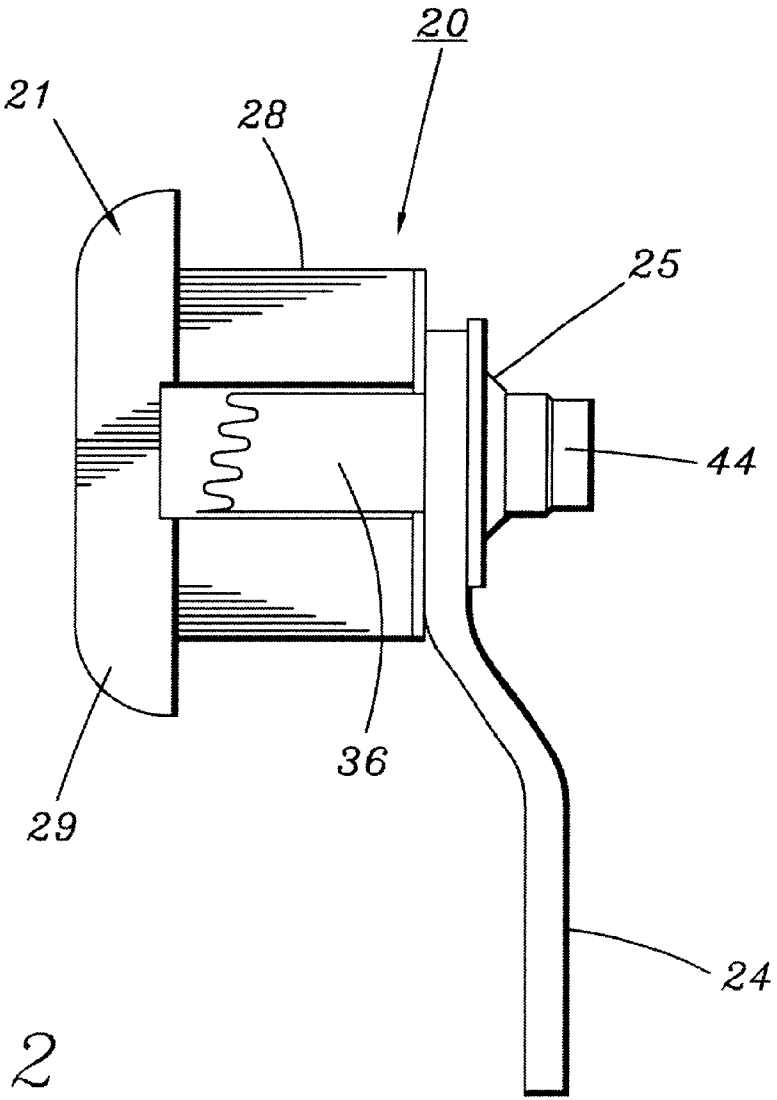
FIG. 2
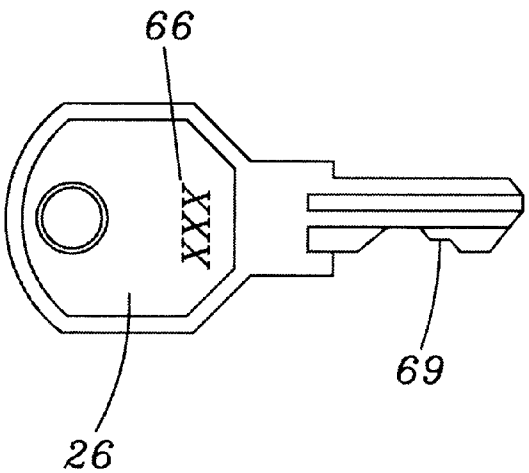

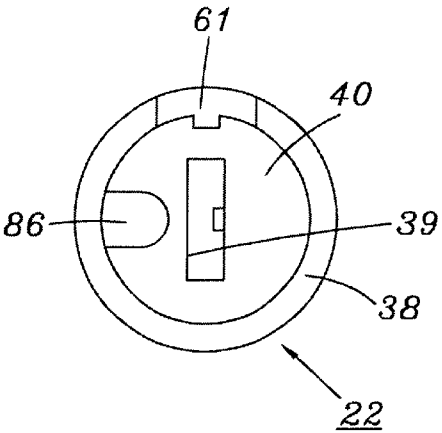
FIG. 19
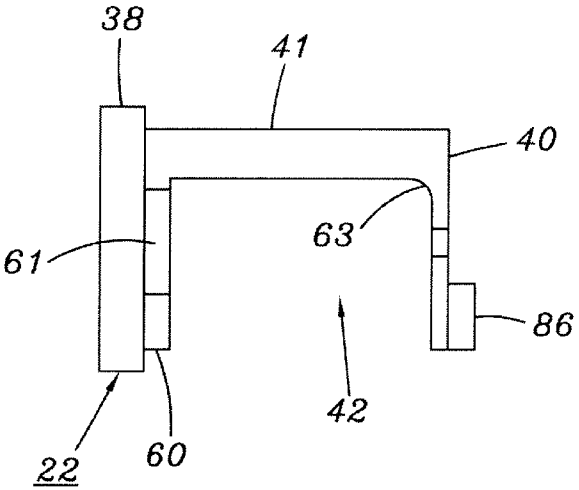
FIG. 20
FIG. 21
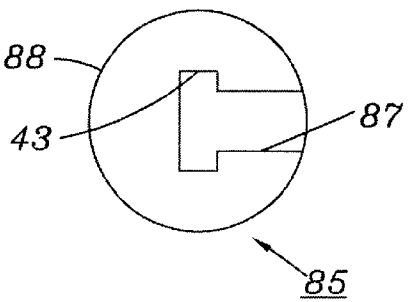
FIG. 22
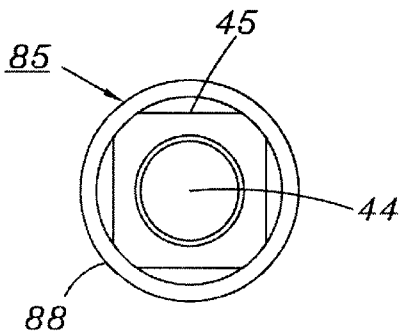
FIG. 23

KEY-OPERATED CYLINDER LOCK WITH REMOVABLE PLATE TUMBLER CONTAINER

TECHNICAL FIELD

This invention relates to key-operated cylinder locks and, more particularly, to constructions for cylinder locks incorporating plate tumblers and manufacturing methods therefore.

BACKGROUND ART

Cylinder locks are well known in the art and widely used in many industries and products for achieving an inexpensive locking system. In typical constructions, cylinder locks are manufactured with spring biased pins or spring biased plates or wafers forming the tumblers for controlling the opening and closing of the lock.

These locks are usually constructed for being key-operated, with the configuration of the key being controlled by the tumbler construction. Once a matching key is inserted into the lock assembly, the spring biased tumblers are moved from a locked position into a released position, allowing the cylinder to rotate in its associated housing. In this way, the lock is opened and the desired locking and unlocking functions are activated.

In most prior art lock constructions, the cylinder comprises an elongated, closed, one-piece construction and is mounted in a cooperating housing which incorporates at least one axially elongated slot or groove. In addition, the cylinder incorporates a plurality of spring biased tumblers either in the form of plates, wafers, or pins, which are constructed for being normally biased into the slot or groove of the housing. In this way, the cylinder is in a locked position when the tumblers are within the slot and the unlocked position when the tumblers are removed from the slot by having the key associated with the particular lock inserted therein.

In the construction of cylinder locks incorporating a plurality of wafers or plates as the tumblers, each wafer or plate comprises a generally rectangular shape incorporating a uniquely dimensioned slot formed therein which is positioned for receiving the key when inserted into the lock assembly. In addition, each wafer or plate comprises a locking fin member which is spring biased to be maintained in the slot or groove of the housing. However, when the appropriate key is inserted through the rectangular slots of the wafer or plate, the plate is moved against the spring forces in a manner which removes the locking fin from the groove, thereby enabling the cylinder to rotate relative to the housing.

Although this basic construction has been widely employed and accepted for use in numerous products, a substantial expense is incurred in manufacturing these locks, due to the tedious and difficult assembly required for constructing and positioning the wafers or plates forming the tumblers for the lock assembly. In most constructions, the cylinder is mass produced with wafer or plate receiving slots or wards formed therein. However, manual assembly is required to insert and set the wafers or plates in the cylinder with the biasing springs to assure that the wafers/plates function as tumblers to control the operation of the lock.

Once the plate tumblers are inserted into the cylinder and prior to insertion of the cylinder into the housing, the spring forces tend to force the plate/tumblers out of the slots. Consequently, holding means are required in order to prevent dislodgement of the plate tumblers. Typically, a separate holding member or a cylinder construction is employed which retains the plate tumblers in position while still enabling the plate to function in its intended manner when assembled in the housing.

One problem, which is frequently encountered during the assembly of the plate tumblers, occurs when plate tumblers are dislodged from the cylinder after insertion therein. When this problem occurs, particularly when two or more tumblers are dislodged, the plate tumblers must be properly reinserted into the cylinder in the correct order. If incorrect reassembly is made, the key constructed for opening the lock by positioning the tumblers in the slot-dislodged position will not function.

A further problem and substantial expense is also incurred whenever a lock assembly is to be changed, by having a new tumbler arrangement installed for requiring a new key configuration to be used to open the lock. In such instances, either the entire lock assembly is removed and replaced, or the wafers/plates forming the tumblers are changed so that a new combination is established and a new key is required. However, in any such change, manual effort and substantial expenses are incurred.

Therefore, it is a principal object of the present invention to provide a cylinder lock construction which eliminates the need for manual assembly of plate tumblers during assembly of the lock.

Another object of the present invention is to provide a cylinder lock construction having the characteristic features described above which is quickly and easily assembled without requiring specialized training.

Another object of the present mention is to provide a cylinder lock construction having the characteristic features described above which completely eliminates any possibility of tumbler dislodgement during the assembly process.

Another object of the present invention is to provide a cylinder lock construction having the characteristic features described above which enables rapid, trouble-free changing of a tumbler combination without substantial expense or difficulty.

Other and more specific objects will in part be obvious and will in part appear hereinafter.

SUMMARY OF THE INVENTION

By employing the present invention, all of the difficulties and drawbacks found with prior art constructions are eliminated and a unique cylinder lock system is attained which is easily and inexpensively manufactured, as well as quickly and easily re-keyed whenever desired. In accordance with the present invention, all of these goals and objectives are realized by operationally mounting the wafers or plates forming the tumblers in an independent, separate, substantially closed container.

In the preferred embodiment, all of the plate tumblers which are desired for the particular lock construction are mounted in the substantially closed container, with each plate tumbler having the requisite spring means associated therewith. In addition, the plate tumbler holding container incorporates one aperture for each plate tumbler which allows the slot engaging fin of each tumbler to extend outwardly from the container.

The container also incorporates a generally rectangular-shaped portal formed at each opposed end of the container and positioned in juxtaposed, spaced alignment with the key receiving slots formed in each plate tumbler. In this way, the key associated with the plate tumblers is inserted directly through the portal of the container and directly aligned with the plate tumblers for effectively moving the plate tumblers as required for operating the cylinder of the lock.

In order to enable the plate tumbler-holding container of the present invention to function in its intended manner, the cylinder of the present invention incorporates a container receiving and holding zone dimensioned for nested engaged relationship with the plate tumbler container. In addition, the holding zone is positioned for enabling the plate tumblers securely retained in the container to cooperate with the fin-engaging slot or groove formed in the housing. In this way, the cooperative, engaged relationship of the plate tumblers' fins in the housing slot is assured and the desired locking and unlocking of the cylinder relative to the housing is provided.

By employing the present invention, the prior art difficulties and high assembly costs are completely eliminated. Instead, a closed, self-contained plate tumbler container assembly is mass produced in advance with each plate tumbler being independently operationally mounted in a single container. In addition, each plate tumbler incorporates a uniquely constructed key receiving slot and cooperates with spring means which normally bias each plate tumbler into a position wherein a slot engaging fin of the tumbler protrudes from the container.

By constructing the plate tumblers in this unique manner, plate tumbler bearing containers are easily transported from manufacture to assembly without fear of any dislodgement of the tumblers from the container, while also enabling the tumbler-bearing container to be quickly and easily assembled with the remaining component of the lock. As a result, all of the prior art drawbacks are eliminated and a uniquely constructed rapidly produced lock assembly system is realized. In this way, locks are capable of being produced substantially more efficiently, effectively, and inexpensively.

In the preferred embodiment, each plate tumbler bearing container is coded to designate the particular construction and arrangement employed for the plate tumblers incorporated therein. As previously discussed, each plate tumbler incorporates a uniquely constructed receiving slot formed therein, which construction dictates the configuration of the cuts formed on the key in order to move the fin of the plate tumbler from engagement with the fin-engaging slot of the housing to disengagement therefrom. As a result, in order to enable the slot construction of the plate tumblers in the container to be readily discernible by viewing only the container, each container is preferably coded in a manner which will inform knowledgeable individuals of the precise key configuration or the corresponding key code identity that is required for using the plate tumbler container in a particular lock assembly.

As is evident from the foregoing detailed disclosure, the expensive, time-consuming labor effort required in manufacturing and assembling prior art cylinder locks is eliminated and, by employing the present invention, a cylinder lock construction is attained quickly and easily, with minimal labor effort required. By employing the present invention, final assembly of the cylinder lock system is quickly obtained by merely mounting the plate tumbler bearing container of the present invention in the receiving zone of the cylinder and inserting the cylinder into the associated housing. Once mounted in place, the remainder of the lock is assembled, in a generally conventional manner, with the particular latching means affixed to the terminating end of the cylinder. Once completed, the lock assembly is ready for installation and use.

In another embodiment of the present invention, a special cylinder lock construction is provided which enables plate tumbler bearing containers to be quickly and easily changed, thereby allowing manufacturers or users to effectively change the lock combination and alter the key configuration associated with a particular lock whenever desired. In order to attain this unique result, the cylinder and the locking means are not affixed directly to each other in their typical manner.

In most constructions, the locking means comprise one selected from the group consisting of locking plates, locking arms, latches, cam arms, and cam operated bars secured to the cylinder for being activated by the rotation of the cylinder when opened. In this embodiment of the present invention, the locking means is constructed as a separate subassembly, mounted in nested, controlled interengagement with the cylinder.

By employing this construction, the rotation of the cylinder forces the locking means to rotate simultaneously therewith, achieving the desired locking and unlocking function. However, if the lock assembly is to be given a new combination, a special release key is employed which enables the entire cylinder and plate tumbler container associated therewith to be removed in their entirety from the housing.

Since the cylinder and lock means are operationally interconnected but not physically secured to each other, the cylinder is removable without disturbing the lock means. Once the cylinder is removed, the plate tumbler containers are changed and the cylinder and new plate tumbler container are returned to the housing for re-installation therein. With this quick and simple process, a new combination is achieved for the lock assembly, with a new key being required to operate the lock.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which:

FIG. 2 is a side elevation view of the lock assembly of FIG. 1 depicted fully assembled with a key member ready for insertion therein;

FIG. 19 is a front view of the cylinder forming member of the lock assembly of FIG. 13;

FIG. 20 is a top plan view of the cylinder forming member of FIG. 19;

FIG. 21 is a rear view of the cylinder forming member of FIG. 19;

FIG. 22 is a front view of the cylinder extension forming a part of the lock assembly of FIG. 13; and FIG. 23 is a rear view of the cylinder extension of FIG. 22.

DETAILED DESCRIPTION

Figure 1:
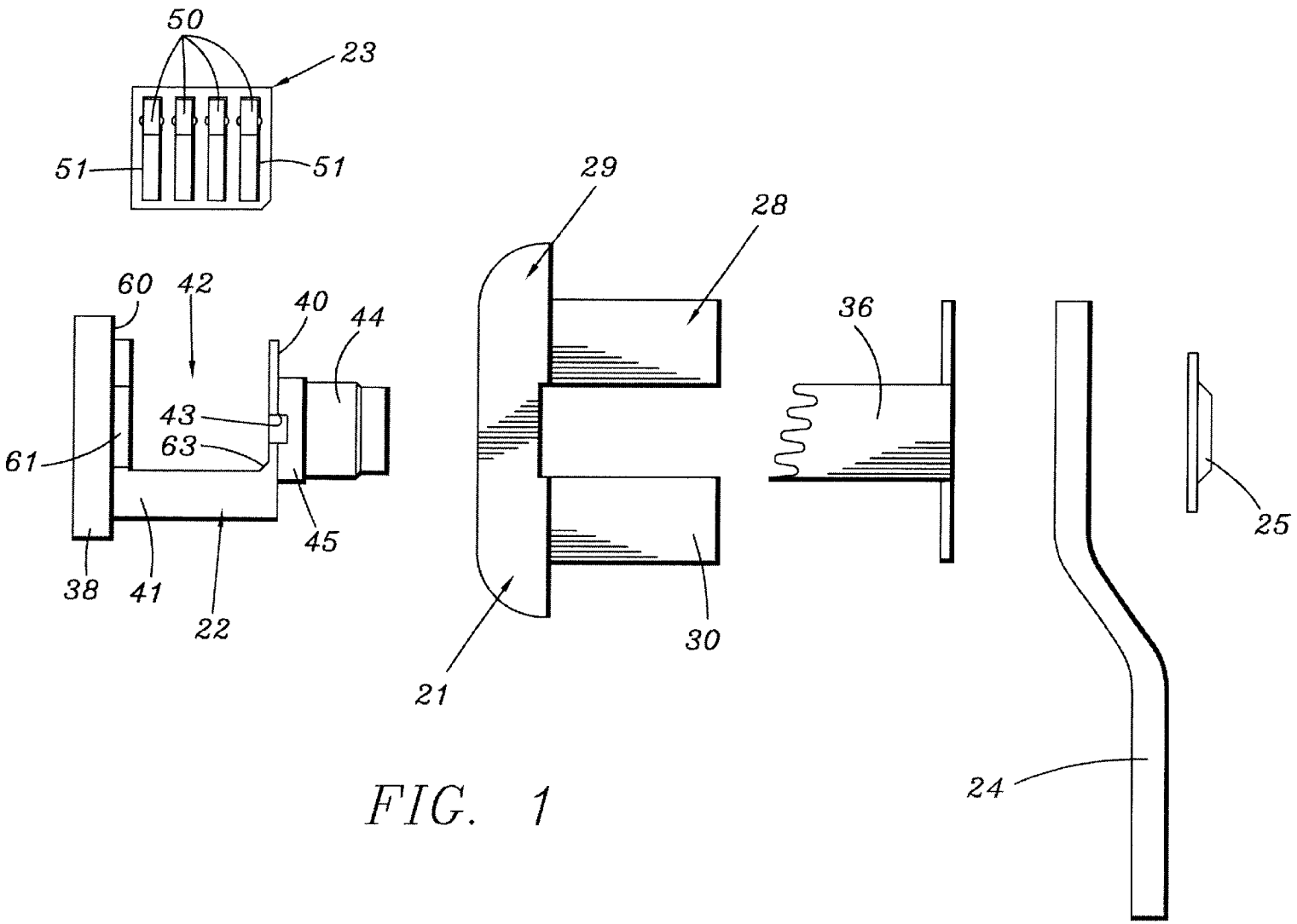
FIG. 1 is an exploded side elevation view depicting one embodiment of the lock assembly of the present invention.

By referring to FIGS. 1–23, along with the following detailed discussion, the construction and operation of the preferred embodiments of the present invention can best be understood. However, alternate constructions can be employed using the teaching of the present invention without departing from the scope of this invention. Consequently, it is to be understood that the following embodiments are intended only as examples of the present invention and are not intended as a limitation thereof.

In FIGS. 1–12, one embodiment of lock assembly 20 of the present invention is shown. In this embodiment, lock assembly 20 comprises housing 21, cylinder forming member 22, plate tumbler container 23, latching means 24, fastener 25, and locking/unlocking key 26. For exemplary purposes, holding ring 36 is depicted with lock assembly 20 for maintaining lock assembly 20 securely affixed in a receiving hole. However, any other holding system can be employed with equal efficacy.

As shown in FIGS. 1–4, in the preferred construction of this embodiment of lock assembly 20, housing 21 comprises a generally hollow cylindrical shaped portion 28 interconnected with an outwardly extending circular shaped rim 29. Rim 29 peripherally surrounds the front end of cylindrical portion 28 and comprises a diameter which is greater than the diameter of cylindrical portion 28, thereby functioning as a positive stop means when lock assembly 20 is inserted into a receiving hole or cavity.

In the preferred construction, cylindrical portion 28 incorporates an outer wall 30, an inner wall 31, and a plurality of flange-receiving slots or grooves 32 formed in inner wall 31. In the embodiment depicted, four separate and independent slots/grooves 32 are formed in housing 21 in spaced, equidistant relationship to each other.

In addition, two diametrically opposed slots 32 extend completely through cylindrical portion 28, effectively establishing two independent arcuate wall members. Although this construction is preferred, numerous alternate constructions can be employed without departing from the present invention.

Cylindrical portion 28 also incorporates flat zones or surfaces 33 formed in outer wall 30. Although flat zones 33 are not required, the incorporation of these flat zones enables housing 21 to be mounted in a receiving cavity in a manner which assures that housing 21 will not be capable of rotation about its central axis.

In completing the construction of this embodiment of housing 21, housing 21 incorporates an arcuate abutment ledge 34 and a cooperating, slightly rearwardly positioned abutment rib 35, both of which radially extend inwardly from inner wall 31 of cylindrical portion 28. As further detailed below, ledge 34 and rib 35 are constructed for cooperating with cylinder forming member 22 to form positive stops for limiting the axial advance of cylinder forming member 22 into housing 21 as well as the rotational movement of cylinder forming member 22 in housing 21.

As depicted in FIGS. 1, 2, and 5–7, in the embodiment of the present invention, cylinder forming member 22 comprises a circular shaped front panel 38 which incorporates a key receiving slot 39 formed therein. Slot 39 controls the orientation of key 26 as well as the length of key 26 which is able to be axially inserted into lock assembly 20. Cylinder forming member 22 also comprises a generally circular shaped rear panel 40 and a side edge 41 extending between and interconnecting front panel 38 with rear panel 40. By employing this construction, a plate tumbler bearing container receiving zone 42 is created, with the spaced distance between front panel 38 and rear panel 40 being equivalent to the length of plate tumbler container 23.

In addition, container receiving zone 42 preferably incorporates beveled edge 63 formed on one corner thereof for cooperating with beveled corner 63 formed on plate tumbler container 23. In this way, assurance is provided that plate tumbler 23 must e assembled in the proper orientation.

Cylinder forming member 22 also preferably comprises groove 60 formed in the rear of front panel 38, extending a substantial portion of the entire circumference thereof. However, groove 60 terminates with a circumferential arc less than 360°, in order to establish positive stop 61. In this way, stop 61 of cylinder forming member 22 cooperates with abutment ledge 34 and abutment rib 35 of housing 21 for enabling cylinder forming member 22 to be arcuately pivotable relative thereto, while having this arc of rotation controllably limited by the contact between stop 61 of cylinder forming member 22 with the terminating edges of ledge 34 of housing 21.

By employing this construction, the precisely desired arcuate distance through which cylinder forming member 22 is able to rotate is precisely controlled. As a result, the plate tumblers mounted in plate tumbler container 23 are automatically positioned in the desired alignment with slots 32 of housing 21.

In this embodiment, rear panel 40 of cylinder forming member 22 incorporates a slot 43 constructed for receiving and stopping the leading front end of key 26. In this way, the axial advance of key 26 into lock assembly 20 is limited and the precisely desired positioning of key 26 in lock 20 is assured.

In addition, rear panel 40 of cylinder forming member 22 incorporates an axially extending boss 44 which is constructed for cooperative controlled engagement with latching means 24. In the embodiment depicted, latching means 24 comprises a locking plate or hook which is arcuately moved by the rotation of cylinder forming member 22.

Figure 8:
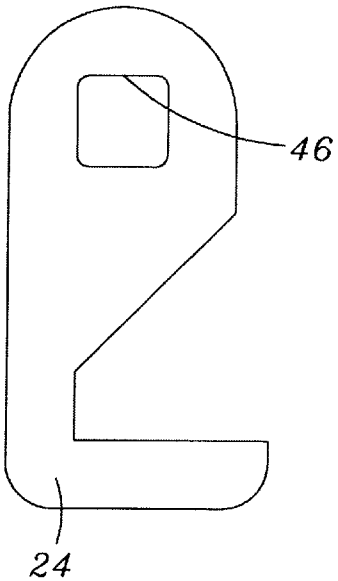
FIG. 8 is a front view of the latching means which forms a part of the lock assembly of FIG. 1.
Figure 4:
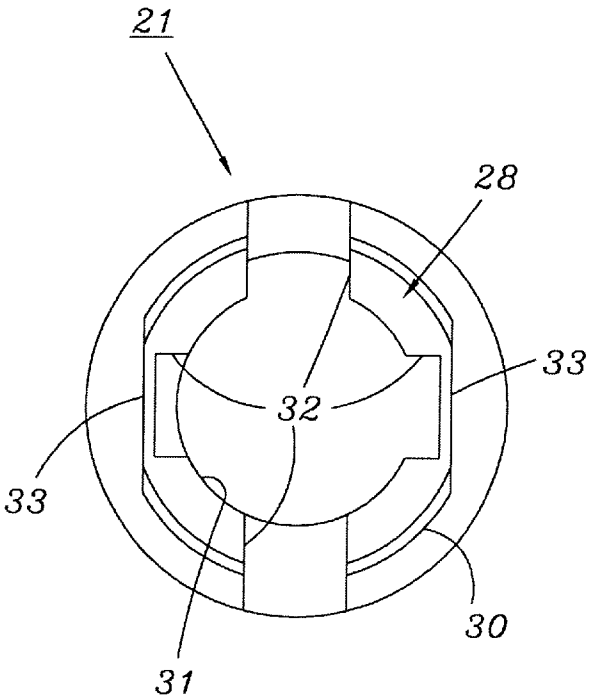
FIG. 4 is a rear view of the housing of FIG. 3.
Figure 3:
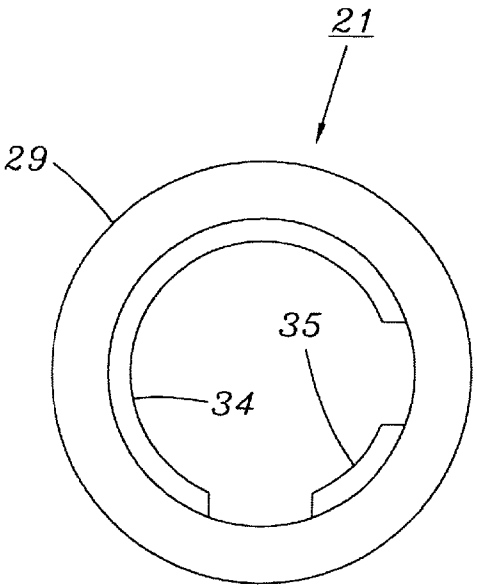
FIG. 3 is a front view of the housing which forms a principal component of the lock assembly of FIG. 1.
Figure 7:
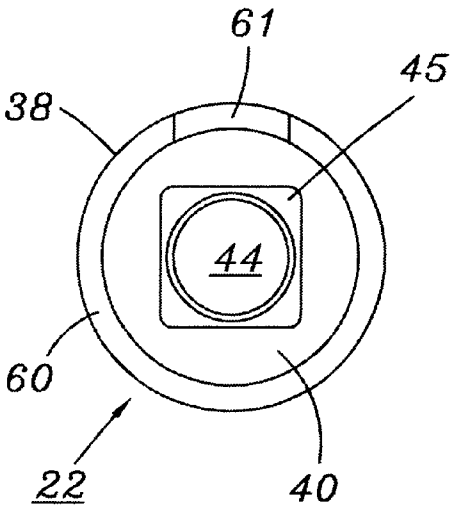
FIG. 7 is a rear view of the cylinder forming member of FIG. 5.
Figure 6:
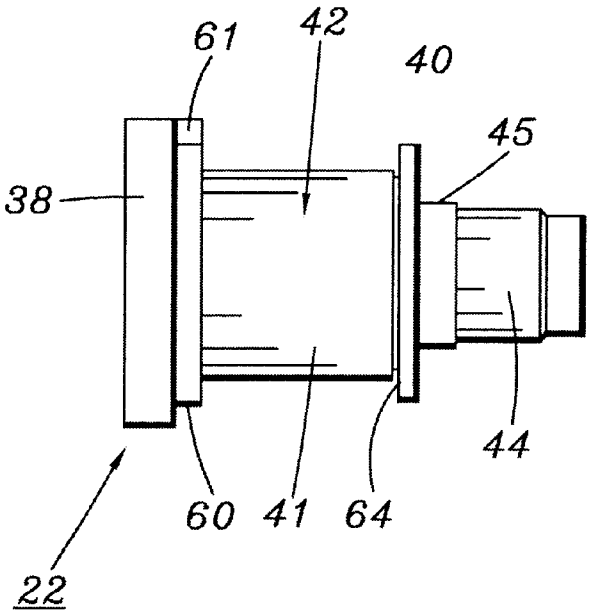
FIG. 6 is a side elevation view of the cylinder forming member of FIG. 5.
Figure 5:
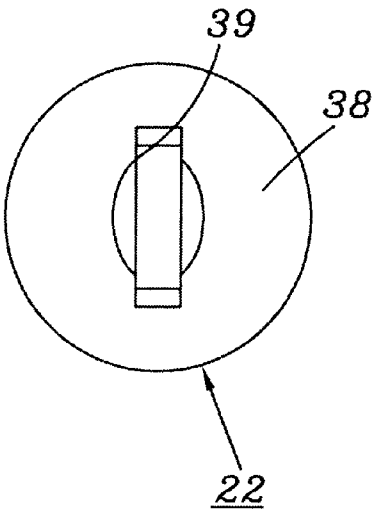
FIG. 5 is a front view of the cylinder forming member which forms a principal component of the lock assembly of FIG. 1.

In the preferred construction, boss 44 comprises a rectangular-shaped portion 45 which is dimensioned for mating nested engagement with rectangular shaped hole 46 formed in latch means 24, as shown in FIG. 8. Consequently, once latch means 24 is mounted to rectangular section 45 of boss 44 and secured thereto by fastening means 25, any arcuate or rotational movement of cylinder forming member 22 causes latch means 24 to arcuately move therewith, enabling latch means 24 to enter an associated locking zone or locking components in order to secure the product to which lock assembly 20 is mounted, as well as be removed from the locking zone or components in order to open the product when desired.

In order to achieve the unique goals and objectives of the present invention, lock assembly 20 comprises plate tumbler container 23, which incorporates a plurality of independent plate tumblers 50 operationally mounted therein. Although four separate plate tumblers are shown for exemplary purposes, any desired quantity of tumbler plates can be employed, depending on the total number of different combination possibilities desired. Plate tumbler container 23 incorporates a housing 47 which is constructed for nested, mounted engagement in receiving zone 42 of cylinder forming member 22 and is dimensioned for completing the generally cylindrical shape of cylinder forming member 22 and enabling the cooperative, arcuately pivotable or rotational movement of cylinder forming member 22 relative to housing 21 once mounted therein.

In the preferred construction, housing 47 comprises substantially flat front wall 48, a substantially flat rear wall 49 and a side wall comprising curved portion 55 and flat portion 56. In addition, a generally rectangular shaped slot 49 is formed in both front wall 48 and rear wall 49 of housing 47, while curved portion 55 incorporates a plurality of separate, independent, and substantially parallel slots or wards 51 formed therein, each of which comprises a plate tumbler 50 mounted therein. Finally, as discussed above, beveled corner 64 is formed between rear wall 49 and flat portion 56 for cooperating with beveled corner 63 of container receiving zone 42.

Each plate tumbler 50 incorporates a locking fin 52 which extends outwardly from container 23 and, as fully detailed below, provides the locked engagement with slots or grooves 32 of housing 21. In addition, each plate tumbler 50 cooperates with a biasing spring 53 which maintains tumbler 50 in its normal position with fin 52 extending outwardly from container 23.

Figure 12:
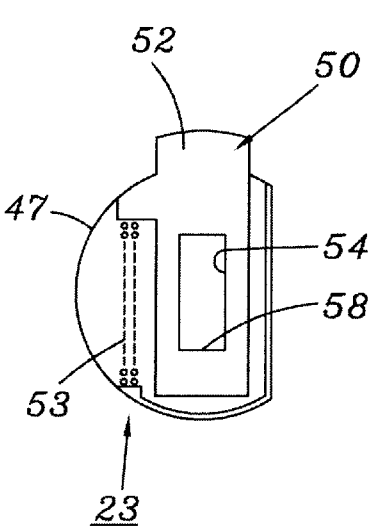
FIG. 12 is a front view of the plate tumbler container of FIG. 9 shown partially in cross-section.
Figure 11:
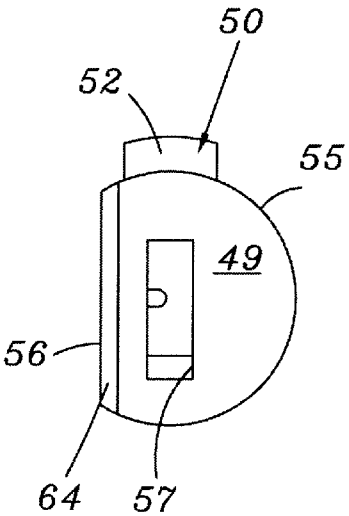
FIG. 11 is a rear view of the plate tumbler container of FIG. 9.
Figure 10:
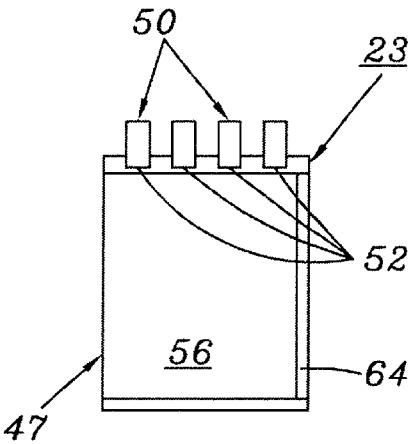
FIG. 10 is a side elevation view of the plate tumbler container of FIG. 9.

In order to complete the construction of plate tumblers 50 and enable plate tumblers 50 to operate in locking and unlocking lock assembly 20, each plate tumbler 50 comprises a uniquely shaped key receiving slot 54. As shown in FIG. 12, slot 54 of each plate tumbler 50 comprises an overall rectangular shape which incorporates a tumbler activation edge 58.

Each plate tumbler 50 is free to move against the biasing forces of spring 53 in the plane established by slot 51 of container 23. However, in order to cause plate tumbler 50 to move in this manner, a force must be imposed upon edge 58 of slot 54 of plate tumbler 50.

By imposing a force on edge 58, plate tumbler 50 is moved against the forces of spring 53 and, if moved a sufficient distance, locking fin 52 is drawn entirely into housing 47 of container 23. This controlling force is provided by key 26 and the configuration or dimension of edge 69 of key 26 contacting edge 58 of plate tumbler 50.

By constructing each slot 54 of each plate tumbler 50 with a unique position for edge 58, a unique key configuration is established which will cause each plate tumbler 50 to be moved into a position with locking fin 52 drawn into housing 47. However, if the wrong key is used, one or more locking fins 52 will remain in slot 32 of housing 21 and cylinder forming member 22 will not rotate to open the desired product.

As previously discussed, key 26, container 23, and key 27, detailed below, all comprise code indicia 66 formed thereon. Code indicia 66 is employed to designate which key is configured for properly operating the plate tumblers 50 mounted in a particular container 23. In this way, identification ease and accuracy are attained.

As is evident from the foregoing detailed disclosure, lock assembly 20 is quickly and easily assembled by employing the unique, pre-assembled and easily installable plate tumbler container 23 of the present invention. However, although the preferred construction for plate tumbler container 23 has been provided, numerous alternate constructions may be implemented without departing from the scope of the present invention. Consequently, all such alternate embodiments are intended to be within the scope of the present invention.

In addition, even though the other components detailed above can be manufactured in alternate configurations, the configuration detailed above provides an easily manufactured, readily assembled configuration for employing the present invention. However, the alternate embodiments evident from this disclosure are intended to be within the scope of this invention.

By referring to FIGS. 13–23 along with the following detailed discussion, the second preferred embodiment of the present invention can best be understood. As previously discussed, the construction detailed herein fully discloses the preferred embodiment of this invention as a single example of the preferred alternate construction that can be employed in carrying out the teaching of this invention. However, numerous alternate constructions or configurations can be implemented without departing from the scope of this invention.

In this embodiment of the present invention, a construction is provided wherein cylinder forming member 22 and plate tumbler container 23 are capable of being removed from housing 21, whenever desired by authorized personnel, in order to change the tumbler combination for lock assembly 20. In this way, any lock assembly 20 is capable of having a new key required for opening the lock assembly, whenever desired by the user, in a manner which is quickly, easily, and inexpensively achieved.

In FIGS. 13–23, as well as the following detailed discussion, similar reference numerals are employed to refer to the same component or structure detailed above in the first embodiment of the present invention. In this way, the common construction features incorporated into both embodiments of the present invention are immediately apparent. However, it is to be understood that this reference system is not intended in any way to limit the present invention, since numerous alternate constructions can be employed without departing from the scope of this invention.

In this embodiment, lock assembly 20 comprises housing 21, cylinder forming member 22, plate tumbler container 23, cylinder extension 85, latching means 24, fastener 25, locking/unlocking key 26, and cylinder releasing key 27. As shown in FIGS. 13–16, in this embodiment, housing 21 comprises two separate and independent components which are matingly interconnected with each other. As depicted, housing 21 comprises face portion 70 and substantially cylindrically shaped rear portion 71.

As more fully detailed below, face portion 70 comprises a plurality of locking flanges 72 which matingly interengage and interconnect with corresponding locking flanges 73 formed in rear portion 71. Once face portion 70 and rear portion 71 are mounted in interengagement with each other, housing 21 is formed and functions in a manner substantially identical to the functioning of housing 21 as detailed above.

Figure 15:
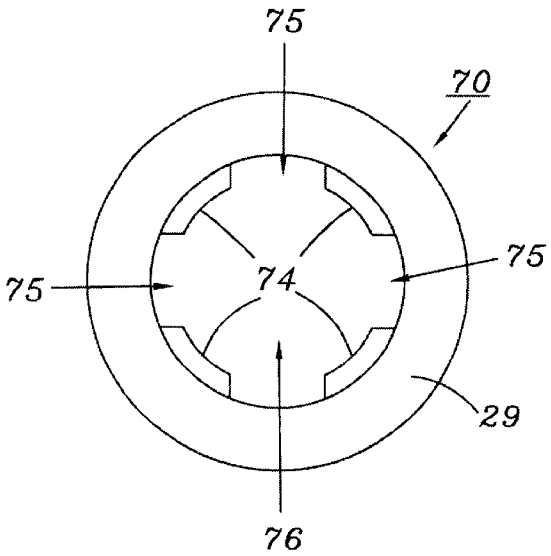
FIG. 15 is a front view of a first portion forming the housing of the lock assembly of FIG. 13.
Figure 16:
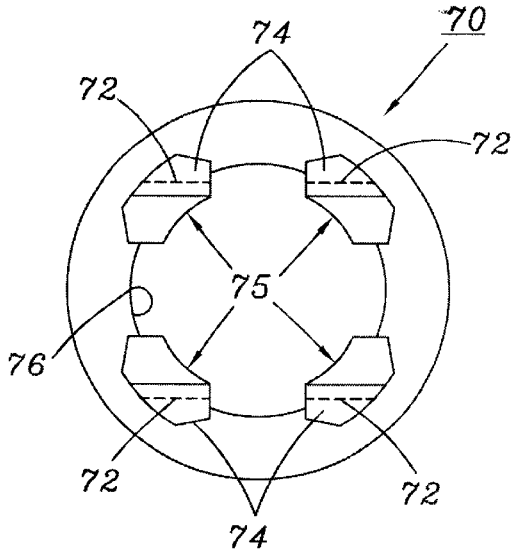
FIG. 16 is a rear view of the first portion of the housing depicted in FIG. 15.

As best seen in FIGS. 15 and 16, face portion 70 preferably comprises a substantially circular shaped rim 29 which functions in the manner detailed above for limiting the axial advance of lock assembly 20 into a receiving hole or cavity. In addition, face portion 70 also incorporates a plurality of upstanding posts 74, perpendicularly extending from the rear surface of rim 29, with posts 74 positioned substantially equidistant from each other and forming open zones 75 therebetween.

As discussed above, each upstanding post 74 terminates with locking flange 72 formed at the terminating distal end thereof. In addition, rim 29 of face portion 70 incorporates portal 76, through which cylinder forming member 22 and plate tumbler container 23 are telescopically inserted and removed. Furthermore, upstanding posts 74 have proximal end portions which extend 42 incorporates beveled corner 64 for cooperating with beveled edge 63 of container 23 to assure proper orientation thereof.

In this embodiment, rear panel 40 incorporates an interconnecting or inter-engaging raised boss 86. As a detailed herein, raised boss 86 is constructed for mating, controlled engagement with a boss receiving zone formed on cylinder extension 85. In this regard, any configuration which is capable of rapid engagement and disengagement as well as controlled driving interconnection can be employed. For exemplary purposes, raised boss 86 is depicted as a substantially rectangular shaped wall, extending substantially perpendicularly from the rear surface of rear panel 40. However, numerous alternate configurations can be employed.

Finally, as with the previous embodiment detailed above for cylinder forming member 22, this embodiment also comprises groove 60 formed in the rear of front panel 38 extending a substantially portion of the entire circumference thereof. However, groove 60 terminates with a circumferential arc less than 360°, in order to establish a positive stop 61. In this way, cylinder forming member 22 is able to cooperate with face portion 70 and the proximal ends of posts 74 for being arcuately pivotable relative thereto, while having this arcuate radially inwardly into portal 76, thereby limiting the axial advance of cylinder forming member 22 by providing a positive abutment stop for front panel 38 thereof. In addition, if desired, the proximal ends of posts 74 may be constructed as discussed above, to limit the arcuate rotational movement of cylinder forming member 22 in housing 21 in order to assure the desired alignment of locking fins 52 of plate tumbler container 23 in slots 32 of housing 21.

Figure 13:
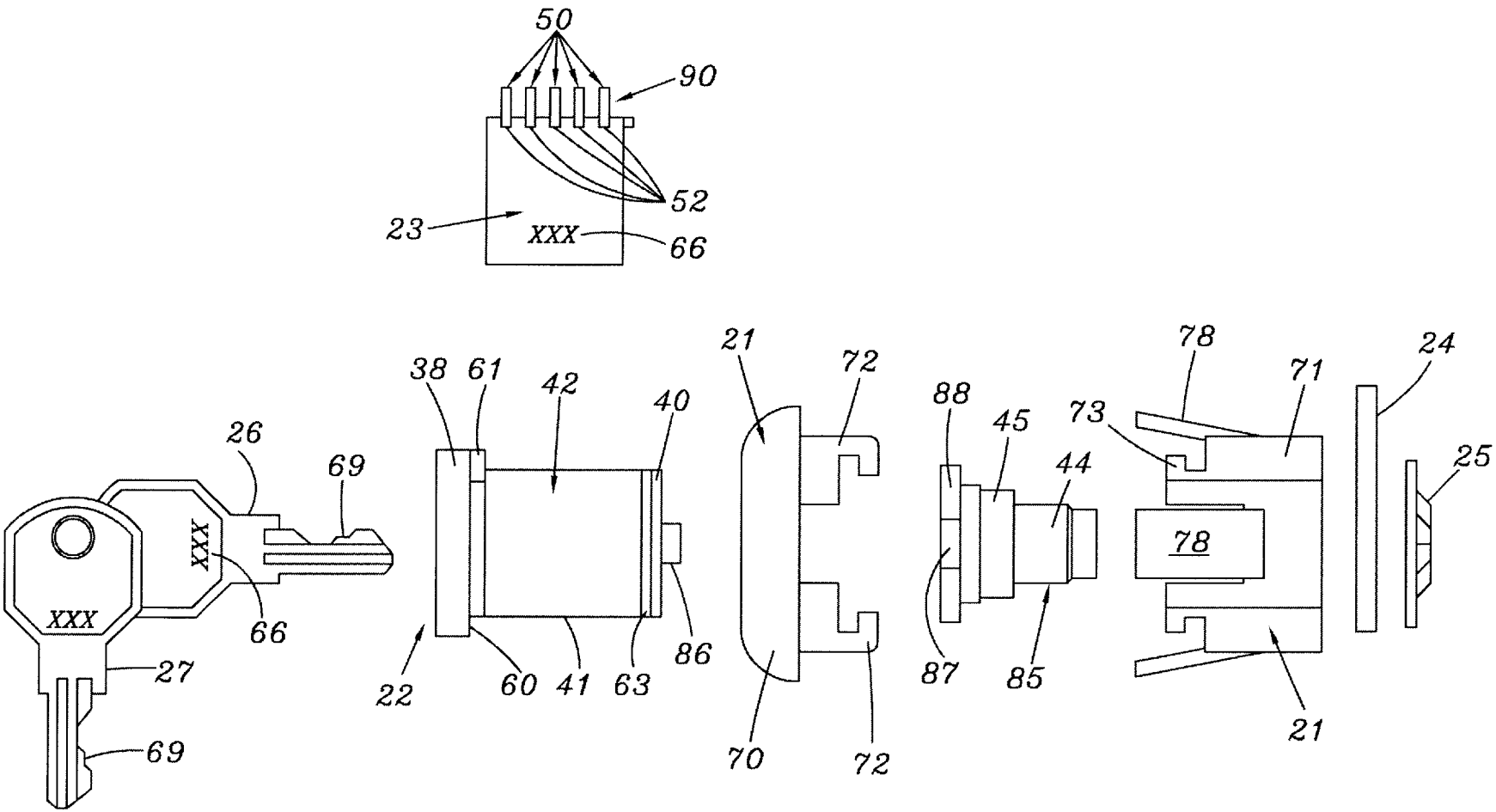
FIG. 13 is an exploded side elevation view of an alternate embodiment of the lock assembly of the present invention.
Figure 17:
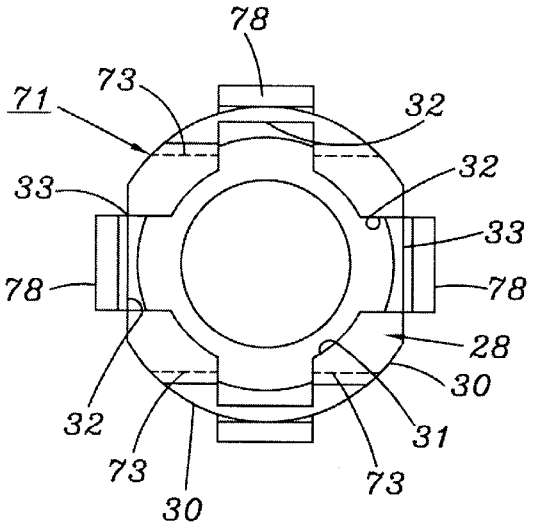
FIG. 17 is a front view of a second portion of the housing of the lock assembly of FIG. 13.
Figure 18:
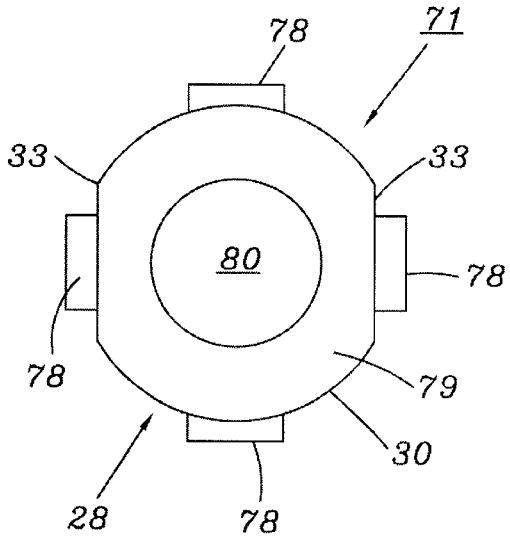
FIG. 18 is a rear view of the second portion of the housing depicted in FIG. 17.

As best seen in FIGS. 17 and 18, substantially cylindrically shaped rear portion 71 of housing 21 comprises outer wall 30, inner wall 31 and a plurality of slots or grooves 32 formed in inner wall 31. In addition, as discussed above, locking flanges 73 are formed in rear portion 71. As depicted in FIG. 13, four separate and independent locking flanges 73 are preferably formed therein, positioned for mating engagement with locking flanges 72 of face portion 70.

Rear portion 71 also comprises four separate and independent finger members 78 extending outwardly from outer surface 30 at an acute angle thereto. In the preferred construction, finger members 78 are positioned for cooperative, mating interengagement with open zones 75 of face portion 70. As a result, when face portion 70 and rear portion 71 are mounted in locked interengagement with each other, finger members 78 of rear portion 71 slidingly engage in open zones 75 formed between upstanding posts 74 of face portion 70. In this way, arcuate rotation of rear portion 71 relative to face portion 70 is prevented.

Rear portion 71 also comprises back panel 79 and portal 80 formed in panel 79. In addition, portal 80 is co-axially aligned with portal 76 of face portion 70 for enabling cylinder forming member 22 and plate tumbler container 23 to be telescopically inserted and cooperatively associated with both portal 76 and portal 80, as well as cylinder extension 85 detailed below.

As shown in FIGS. 13, 14, 19, 20, and 21, this embodiment of cylinder forming member 22 is similar to the previous embodiment and comprises a circular shaped front panel 30 which incorporates a key receiving slot 39 formed therein with slot 39 controlling the orientation of keys 26 and 27, as well as the length of the axially insertion of keys 26 and 27 into lock assembly 20.

Cylinder forming member 22 also comprises a generally circular shaped rear panel 40 and side edge 41 extending between and interconnecting front panel 38 with rear panel 40. By employing this construction, a plate tumbler bearing container receiving zone 42 is created, with the spaced distance between front panel 38 and rear panel 40 being equivalent to the length of plate tumbler container 23. As with the embodiment detailed above, receiving zone rotation controllably limited by the proximal ends of posts 74 or other flange means formed in face portion 70.

In the preferred construction of this embodiment of the present invention, plate tumbler container 23 and plate tumblers 50 are constructed in the manner detailed above in the first embodiment. Consequently, a detailed discussion of the construction need not be provided, since the discussion above should be incorporated herein by reference. However, as is fully detailed below, at least one additional cylinder locking late tumbler is mounted on container 23. This single construction variation is fully disclosed below.

By referring to FIGS. 13, 14, 22 and 23, along with the following detailed discussion, the construction and operation of cylinder extension 85 can best be understood. In the preferred embodiment, cylinder extension 85 incorporates a substantially circular shaped front panel 88 on which is formed a boss receiving zone 87. Boss receiving zone 87 is constructed with a size and shape for receiving and providing mating interengagement with boss 86 of cylinder forming member 22. As discussed above, in this embodiment, boss 86 comprises a generally rectangular shaped wall, while boss receiving zone 87 comprises a similarly dimensioned, rectangular shaped cavity.

In completing the construction of cylinder extension 85, boss 44 is formed on the rear surface of panel 86, with boss 44 axially extending therefrom. As depicted, in this embodiment, boss 44 comprises a rectangular shaped portion 45 which is dimensioned for mating, interengagement in rectangular shaped hole 46 formed in latch means 24.

Figure 14:
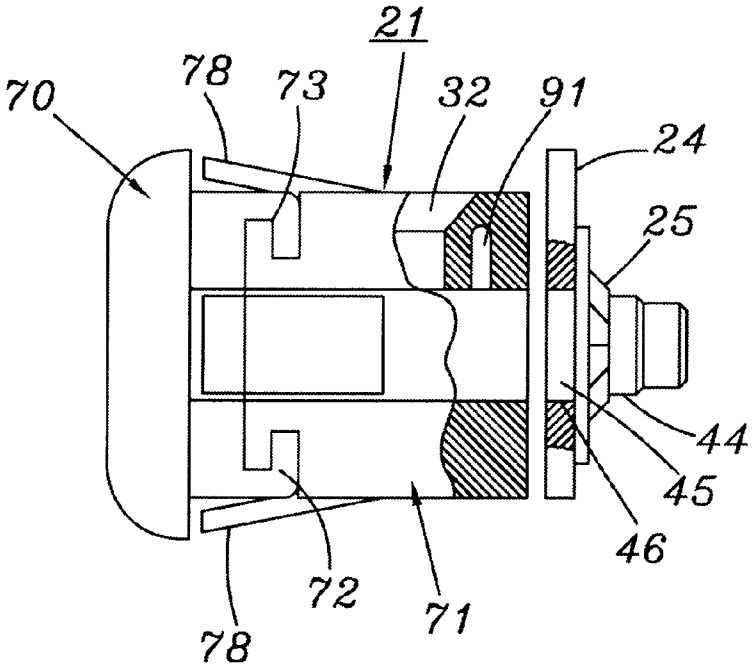
FIG. 14 is a side elevation view of the lock assembly of the present invention, partially in cross-section shown with the cylinder forming member and plate tumbler container disengaged from the housing.
Figure 14:
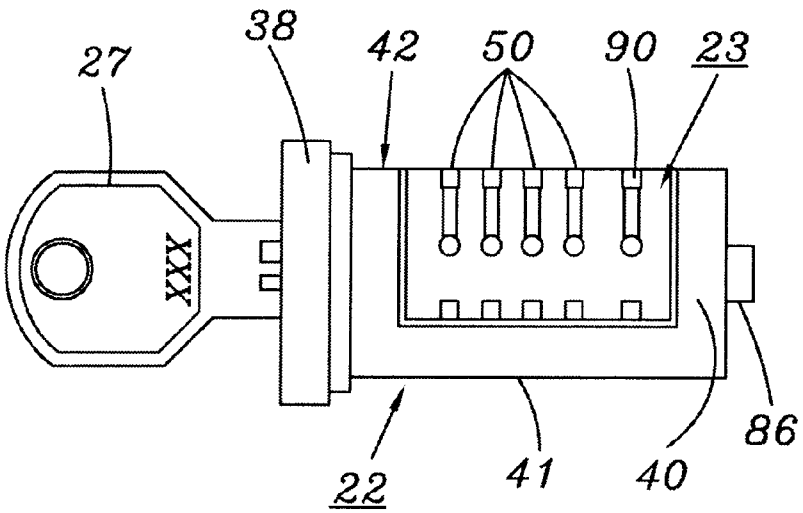

By employing this construction, as best seen in FIGS. 13 and 14, once latch means 24 is mounted to rectangular section 45 of boss 44 and securely affixed thereto by mounting fastening means 25 on boss 44, any rotational movement of cylinder extension 85 causes latch means 24 to arcuately moved therewith. In this way, latch means 24 is able to enter, engage, or activate any locking components associated therewith in order to secure the product to which lock assembly 20 is mounted as well as enable the disengagement of the locking components whenever the product is to be open.

As is evident from the foregoing detailed disclosure, once housing 21 is assembled by lockingly interengagement of face portion 70 with rear portion 71, cylinder extension 85 is mounted in the interior cavity formed by inner wall 31 of housing 21, with boss 44 thereof extending outwardly from portal 80 of back panel 79. Then, latch means 24 is mounted on rectangular portion 45 of boss 44 and latch means 24 is secured in this position by mounting fastening means 25 on boss 44.

Figure 9:
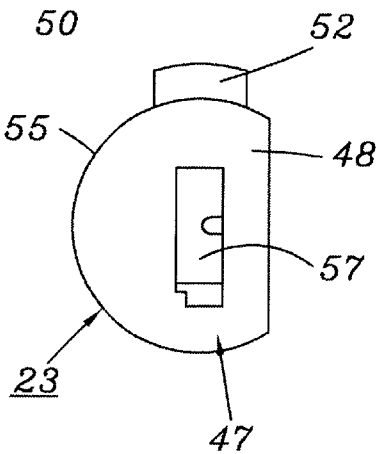
FIG. 9 is a front view of the plate tumbler container which forms a principal component of the lock assembly of FIG. 1.

In order to prevent cylinder forming member 22 from being removed from housing 21 whenever key 26 is inserted therein, the preferred construction of this embodiment of lock assembly 20 incorporates an additional cylinder locking plate tumbler 90 mounted in plate tumbler container 23. Furthermore, in the preferred embodiment, cylinder locking plate tumbler 90 is mounted in an associated arcuate slot 91 formed in inner wall 32 of housing 21. In addition, cylinder locking plate tumbler 90 is preferably mounted at the rear end of the container 23, thereby requiring special, longer key 27 to activate plate tumbler 90 and remove the locking fin thereof from arcuate slot 91. This special key is shown in FIG. 9 as cylinder releasing key 27.

By constructing lock assembly 20 of the present invention in this manner, the quick and easy removal of cylinder forming member 22 from housing 21 is achieved by only authorized personnel who possess cylinder releasing key 27. In this way, whenever an individual inserts cylinder releasing key 27 into cylinder forming member 22, all of the locking fins 52 of plate tumblers 50 and plate tumbler 90 are removed from slot 32 of housing 21, enabling cylinder forming member 22 and container 23 to be removed in their entirety from housing 21. Once removed, plate tumbler container 23 is quickly and easily removed and replaced with a new plate tumbler container, requiring a new key to be needed for operating lock assembly 20.

In an alternate construction, key 27 is constructed to partially withdraw the locking fin of late tumbler 90 from slot 91. In this way, the removability of cylinder forming member 22 and container 23 from housing 21 is further controlled. In this regard, many applications may desire a universal key 27 to be employed for removing and changing container 23. However, in order to assure that only authorized personnel are able to remove container 23, key 26 must also be used.

In this construction, slot 91 is interconnected to slot 32 of housing 21 in the open position. Preferably, this interconnection comprises a slotted channel which is less than the full depth of slot 91, but greater than the height of locking fin 52 of late tumbler 90 when key 27 is inserted therein. As a result, the authorized individual desiring to replace container 23 must employ key 26 to move lock assembly 20 from its locked position to its unlocked position. Then, key 27 is inserted, causing plate tumbler 90 to be partially withdrawn into container 23, however, having a height which clears the depth of the connecting channel between slots 32 and 91, enabling cylinder forming member 22 and container 23 to be removed from housing 21.

The final construction of lock assembly 20 of the present invention is quickly and easily completed by placing plate tumbler container 23 in container receiving zone 42 of cylinder forming member 22 and telescopically advancing cylinder forming member 22 and container 23 into housing 21, preferably with key 27 mounted in cylinder forming member 22. Then, once key 27 is removed from cylinder forming member 22 and its associated plate tumbler container 23, locking fins 52 of plate tumblers 50 are released and enter the associated slot 32 of housing 21, while plate tumbler 90 is released and enters slot 91. Once locking fins 52 are positioned in slot 32 of housing 21, with plate tumbler 90 separately secured in slot 91, lock assembly 20 is secured in the particular position, incapable of having cylinder forming member 22 arcuately rotated relative to housing 21 until the appropriate key is inserted therein.

In addition, as is evident from the foregoing detailed discussion, when key 26 is inserted into cylinder forming member 22 and plate tumbler container 23, causing locking fins 52 of plate tumblers 50 to be withdrawn from slot 32 of housing 21, cylinder forming member 22 is able to arcuately pivot about its central axis within housing 21. Furthermore, with boss 86 of cylinder forming member 22 interengaged with boss receiving zone 87 of cylinder extension 85, the arcuate pivoting movement of cylinder forming member 22 simultaneously causes cylinder extension 85 to arcuately pivot therewith. In this way, the arcuate movement of latch means 24 is realized and the desired locking and unlocking of the associated lock members in the product is activated. However, although the use of key 26 enables cylinder forming member 22 and container 23 to be arcuately related relative to housing 21, removal of cylinder forming member 22 and container 23 from housing 21 is not possible using only key 26.

As discussed above, in this embodiment of the present invention, lock assembly 20 is constructed to enable cylinder forming member 22 and plate tumbler container 23 to be quickly and easily removed from housing 21, whenever desired by an authorized user. In this way, plate tumbler container 23 is easily replaced with a new plate tumbler container, so that the key required for operating lock assembly 20 can be quickly changed.

As is evident from the foregoing detailed discussion, when key 27 is inserted into cylinder forming member 22 in a manner which causes the locking fins 52 of plate tumblers 50 to be removed from slot 32 of housing 21, while also causing plate tumbler 90 to be removed from slot 91, cylinder forming member 22 with plate tumbler container 23 is capable of being axially removed in its entirety from housing 21. Since cylinder forming member 22 is engaged with the remaining components of lock assembly 20 by only the sliding engagement of boss 86 with boss receiving zone 87, the axial removal of cylinder forming member 22 and container 23 from housing 21 is easily attainable once all of the locking fins 52 of plate tumblers 50 and plate tumbler 90 have been removed from slot 32 and 91 of housing 21.

Whenever key 26 is inserted into cylinder forming member 22, only plate tumblers 50 are activated, allowing cylinder forming member 22 to arcuately pivot within housing 21. However, since cylinder locking plate tumbler 90 remains engaged in slot 91, the removal of cylinder forming member 22 from housing 21 is not possible.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood of the following claims are intended to cover all of the generic and specific features of the invention herein described, and all statements of the scope of the invention which, as a matter of language, might be said to fall therebetween.

Having described my invention, what I claim as new and desired to secure by Letters Patent is:

1. A lock assembly for use with any desired product and constructed for cooperating with a first key for activation thereof and a second key for partial disassembly thereof comprising:

A. a housing constructed for being mounted in a receiving zone formed in a product and comprising
   a. a cylinder receiving cavity dimensioned for mating engagement with a cylinder member,
   b. at least one longitudinally-extending slot formed in the cylinder receiving cavity, and
   c. at least one arcuate slot formed in the cylinder receiving cavity;

B. a cylinder forming member constructed for removable mounted engagement in the receiving cavity of the housing and comprising
   a. a front panel constructed for mating engagement with the housing and incorporating a key-receiving portal formed therein;
   b. a rear panel
      1. positioned in juxtaposed, spaced, facing relationship with the front panel, and
      2. comprising latch engaging means extending from the rear panel, and
   c. a plate tumbler container receiving zone formed between the front panel and rear panel and dimensioned for receiving and retaining a cooperating plate tumbler container, and C. a separate and independent plate tumbler container dimensioned for secure, mounted, retained engagement in the receiving zone of the cylinder-forming member in cooperating relationship with the cylinder receiving cavity of the housing and comprising
   a. a key entry portal formed in a wall of the container for alignment with the key receiving portal of the cylinder,
   b. a plurality of slots formed in the container in juxtaposed, spaced, parallel relationship with each other,
   c. a first tumbler set comprising a plurality of plate tumblers separately mounted in one of said plurality of slots for independent movement therein between a first locking position and a second unlocked position in response to the insertion of a first key,
   d. a second tumbler set comprising at least one plate tumbler separately mounted in a slot of the container for independent movement therein between a first locking position and a second unlocked position in response to the insertion of a second key,
   e. a plurality of spring means mounted with the plurality of plate tumblers forming the first set for normally biasing each plate tumbler into the first locked position in cooperating engagement with the longitudinally-extending slot of the housing,
   f. each of said plate tumblers forming the first set comprising activation means responsive to the first key structure for moving each of the plate tumblers from its first locked position to its second unlocked position thereby enabling arcuate movement of the cylinder-forming member and plate tumbler container relative to the housing to be achieved,
   g. spring means mounted with the plate tumblers forming the second set for normally biasing each plate tumbler into the first locked position in cooperating engagement with the arcuate slot of the housing, and
   h. each of said plate tumblers of the second set comprising activation means responsive to the second key structure for moving the plate tumbler from its first locked position to its second unlocked position thereby enabling axial movement of the cylinder-forming member and plate tumbler container relative to the housing to be achieved whereby a lock assembly is realized that can be quickly and easily constructed without loss or dislodgement of plate tumblers from their retained position and is able to have a plate tumbler container removed and replaced with ease.

2. The lock assembly defined in claim 1, wherein each plate tumbler comprises a locking fin biased by said spring means for normally extending outwardly from the container for locking engagement with the longitudinally extending slot of the housing, thereby defining the first locked position.

3. The lock assembly defined in claim 2, wherein each plate tumbler further comprises a key-receiving slot formed therein, positioned in cooperating alignment with the key entry portal formed in a wall of the container.

4. The lock assembly defined in claim 3, wherein the activation means of each plate tumbler comprises one edge of the key receiving slot positioned for sliding, co-operative engagement with a combination defining edge formed on said key, whereby engagement of the key with said edge of said slot causes the plate tumbler to move into its second unlocked position wherein the locking fin is withdrawn from engagement with the longitudinally extending slot of the housing.

5. The lock assembly defined in claim 4, wherein the front panel and rear panel of the cylinder forming member both comprise generally circular shapes and are interconnected to each other by a side wall having a substantially curved outer edge and a substantially flat inner edge for forming the plate tumbler container receiving zone in a generally U-shape.

6. The lock assembly defined in claim 5, wherein the substantially flat inner edge of the side wall incorporates a beveled corner formed at the juncture with the rear panel for cooperating with a similarly dimensioned beveled edge formed on a wall of the separate and independent plate tumbler container, thereby assuring proper orientation out of the plate tumbler container in said container receiving zone of the cylinder forming member.

7. The lock assembly defined in claim 6, wherein the plate tumbler container is further defined as comprising a curved outer wall constructed for cooperating with the curved outer edge of the side wall of the cylinder forming member for establishing a substantially cylindrically shaped member when fully assembled for insertion into the housing.

8. The lock assembly defined in claim 7, wherein said housing is further defined as comprising a rim portion radially extending outwardly for engagement with the product receiving zone for limiting the axial advance of the housing therein and said cylinder receiving cavity comprises at least two longitudinally extending slots formed therein.

9. The lock assembly defined in claim 8, wherein said housing further comprises abutment stops constructed for cooperating with the front panel of the cylinder forming member for limiting the arc of rotation through which the cylinder forming member can move when mounted in the receiving cavity of the housing, thereby assuring alignment of the locking fins extending from the plate tumbler with the longitudinally extending slots of the housing.

10. The lock assembly defined and claim 4, wherein said latch engaging means extending from the rear panel of the cylinder forming member is further defined as comprising an axially extending, elongated boss.

11. The lock assembly defined in claim 4, wherein said cylinder receiving cavity formed in the housing further comprises a rear panel incorporating a portal formed therein and said lock assembly further comprises a cylinder extension member rotationly mounted in said portal of said housing.

12. The lock assembly defined in claim 11, wherein said cylinder extension means is further defined as comprising a front panel having a dimension greater than the diameter of the portal formed in the rear panel of the housing and incorporating a drive receiving zone formed on one surface thereof and an axially extending elongated boss formed on the opposite surface thereof.

13. The lock assembly defined in claim 12, wherein said boss of said cylinder extension means axially extends through said portal with the front panel contacting the rear wall of the housing.

14. The lock assembly defined in claim 13, wherein the latch engaging means extending from the rear panel of the cylinder forming member is further defined as comprising an axially extending drive member positioned for cooperative removable engagement with the cylinder extension member mounted to said housing.

15. The lock assembly defined in claim 14, wherein said axially extending, elongated boss comprises a generally rectangular shaped base for receiving and controllably engaging lock engaging means mounted thereto and securely retained thereon by fastening means.

16. The lock assembly defined in claim 15, wherein said locking engaging means comprises one selected from the group consisting of locking plates, locking arms, latches, cam arms, and cam engaging and cam controlling means.

17. The lock assembly defined in claim 1, wherein the arcuate slot is formed in a rear portion of the cylinder receiving cavity of the housing, and the second tumbler set is further defined as being located at the rear of the plate tumbler container for cooperating engagement with the arcuate slot, thereby controlling the axial movement of the cylinder forming member relative to the housing and the removal and replacement of the plate tumbler container.

18. The lock assembly defined in claim 17, wherein said second key is further defined as comprising an overall length greater than the first key for cooperative engagement with the second set of plate tumblers for moving the plate tumblers forming the second set from its first locked position to its second unlocked position, enabling the cylinder forming member and plate tumbler container to be axially removed from the housing for quick, easy and inexpensive changing of the plate tumbler container of any desired lock assembly.

* * * * *